US006480166B2

(12) United States Patent
Tsai et al.

(10) Patent No.: US 6,480,166 B2
(45) Date of Patent: Nov. 12, 2002

(54) PLANAR PRINTED CIRCUIT ANTENNA

(75) Inventors: Szu-Nan Tsai, Tu-Chen (TW); Chung-Yen Yang, Tu-Chen (TW); Hsien Chu Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,242

(22) Filed: Dec. 28, 2000

(65) Prior Publication Data

US 2002/0005811 A1 Jan. 17, 2002

(30) Foreign Application Priority Data

Jul. 14, 2000 (TW) ..... 89114152 A

(51) Int. Cl.[7] ..... H01Q 1/38
(52) U.S. Cl. ..... 343/795; 343/815
(58) Field of Search ..... 343/795, 821, 343/813, 814, 815; H01Q 1/38

(56) References Cited

U.S. PATENT DOCUMENTS 3,587,110 A * 6/1971 Woodward ..... 343/814
4,587,525 A * 5/1986 Parsons et al. ..... 343/821
4,656,483 A * 4/1987 Jaquet ..... 343/745
5,999,141 A * 12/1999 Weldon ..... 343/821

* cited by examiner

*Primary Examiner*—Michael C. Wimer
(74) *Attorney, Agent, or Firm*—WeiTe Chung

(57) ABSTRACT

A planar printed circuit antenna (1) comprises a printed circuit board (PCB) (10) mounted on an insulative substrate (100), a plurality of electronic dipole units (20) and a coaxial feeder element (30). The PCB comprises an upper layer (101), and a lower layer (102) opposite the upper layer and fixed on the insulative substrate. The coaxial feeder element includes an RF cable (305), and a neck (303) securely attached around the RF cable for engaging the coaxial feeder element with the substrate. The RF cable has a conducting core wire (301) connected to the upper layer via a jumper wire (304), and an outer conductor (302) around the conducting core wire directly connected to the lower layer. The electronic dipole units are respectively arranged on the upper and lower layers of the PCB, and are respectively coupled to the conducting core wire and the outer conductor. The PCB has space available for accommodating the jumper wire of varying length. The jumper wire has an insulative coating. In cooperation with the available space of the PCB the jumper wire is adapted to be easily substituted by the other jumper wire having different length, thereby changing an effective frequency band of the antenna.

8 Claims, 7 Drawing Sheets

PLANAR PRINTED CIRCUIT ANTENNA

FIELD OF THE INVENTION

The present invention relates to a planar printed circuit antenna, and in particular to an antenna module working in the ISM (Industry, Science, Medicine) frequency band and assembled in an interior of portable electronic equipment.

BACKGROUND OF THE INVENTION

A conventional planar printed circuit antenna is disclosed in U.S. Pat. No. 5,708,446. The planar printed circuit antenna is driven by RF signals from a coaxial feed line, and symmetrical transducers are added between symmetrical dipoles to modify the amplitude and phase of the current coming from or going to the dipoles. By this means the antenna can be oriented in a particular direction, and can operate in a designated frequency band. However, symmetrical transducers are not appropriate for use in some antenna systems, such as corner reflection antenna systems. Furthermore, antennas with symmetrical transducers have large profiles and complex structures. Such antennas require additional integrated circuits, and production of them entails much difficulty and complexity.

Referring to FIGS. 6–7 obtained from U.S. Pat. No. 5,708,446, a coaxial feeder element of a conventional planar printed circuit antenna includes an RF cable comprising a conducting core wire 701 and an outer conductor 702. The conducting core wire 701 and outer conductor 702 respectively connect with an upper circuit trace 601 and a lower circuit trace 602 of a printed circuit board (PCB) 60. The PCB is mounted on an insulative substrate 600. The conducting core wire 701 and outer conductor 702 are directly welded to the upper circuit trace 601 and lower circuit trace 602 respectively, and drive the planar printed circuit antenna. The fixed lengths of the conducting core wire 701 and outer conductor 702 restrict the range of the antenna frequency band, and consequently limit the scope of proper operation of the antenna.

For example, a notebook PC with an antenna mounted therein may be used in a variety of different locations. When the notebook PC is moved from one location to another, the environment in the other location may well be different. This can affect the proper functioning of the notebook PC. Thus the frequency band of the notebook computer's antenna may well have to be altered, to adapt the antenna to the altered environment. Otherwise, the notebook PC may operate improperly or not at all.

The configuration of a conventional antenna mounted in electronic equipment can be modified to operate in a different antenna frequency band. For example, the entire PCB may be replaced with a PCB having a different thickness. However, such modification entails significant downtime and increased costs. Lengthening the antenna to make the syntonous frequency band shift to a lower frequency is a common type of modification. However, this creates difficulties when attempting to design electronic equipment which can be adapted to have its antenna lengthened at a later time. In addition, electronic equipment such as Personal Digital Assistants (PDAs), notebook PCs, mobile phones, and so on are becoming smaller and smaller. Thus the space available in any such equipment for lengthening of an antenna is becoming more and more limited.

Hence, an improved antenna module is desired to overcome the above-mentioned shortcomings of existing wireless network equipment.

SUMMARY OF THE INVENTION

A main object of the present invention is to provide a planar printed circuit antenna for use in wireless network devices and having an easily changeable effective frequency band.

Another object of the present invention is to provide an antenna feeder method which can conveniently change the effective frequency band of a wireless network device according to varying needs.

A further object of the present invention is to provide a planar printed circuit antenna which occupies minimal space and which reduces costs.

A planar printed circuit antenna in accordance with the present invention for use in an electronic device comprises a printed circuit board (PCB) mounted on an insulative substrate, a plurality of electronic dipole units, and a coaxial feeder element. The PCB comprises an upper layer, and a lower layer opposite the upper layer and fixed on the insulative substrate. The coaxial feeder element includes an RF cable and a neck securely attached around the RF cable for engaging the coaxial feeder element with the substrate. The RF cable has a conducting core wire,and an outer conductor around the conducting core wire. The conducting core wire is connected to the upper layer via a jumper wire, and the outer conductor is directly connected to the lower layer. Each electronic dipole unit comprises a first and second half dipole respectively arranged on the upper layer and lower layer of the PCB, and respectively coupled to the conducting core wire and the outer conductor. The PCB has space available for accommodating a jumper wire of variable length. The jumper wire has an insulative coating. In cooperation with the free space of the PCB, the jumper wire is adapted to be easily substituted by another jumper wire having a different length, thereby changing an effective frequency band of the antenna.

Other objects, advantages and novel features of the invention will become more apparent from the following detailed description when taken in conjunction with the accompanying drawings.

DETAILED DESCRIPTION OF THE INVENTION

Reference will now be made in detail to a preferred embodiment of the present invention.

Figure 1:
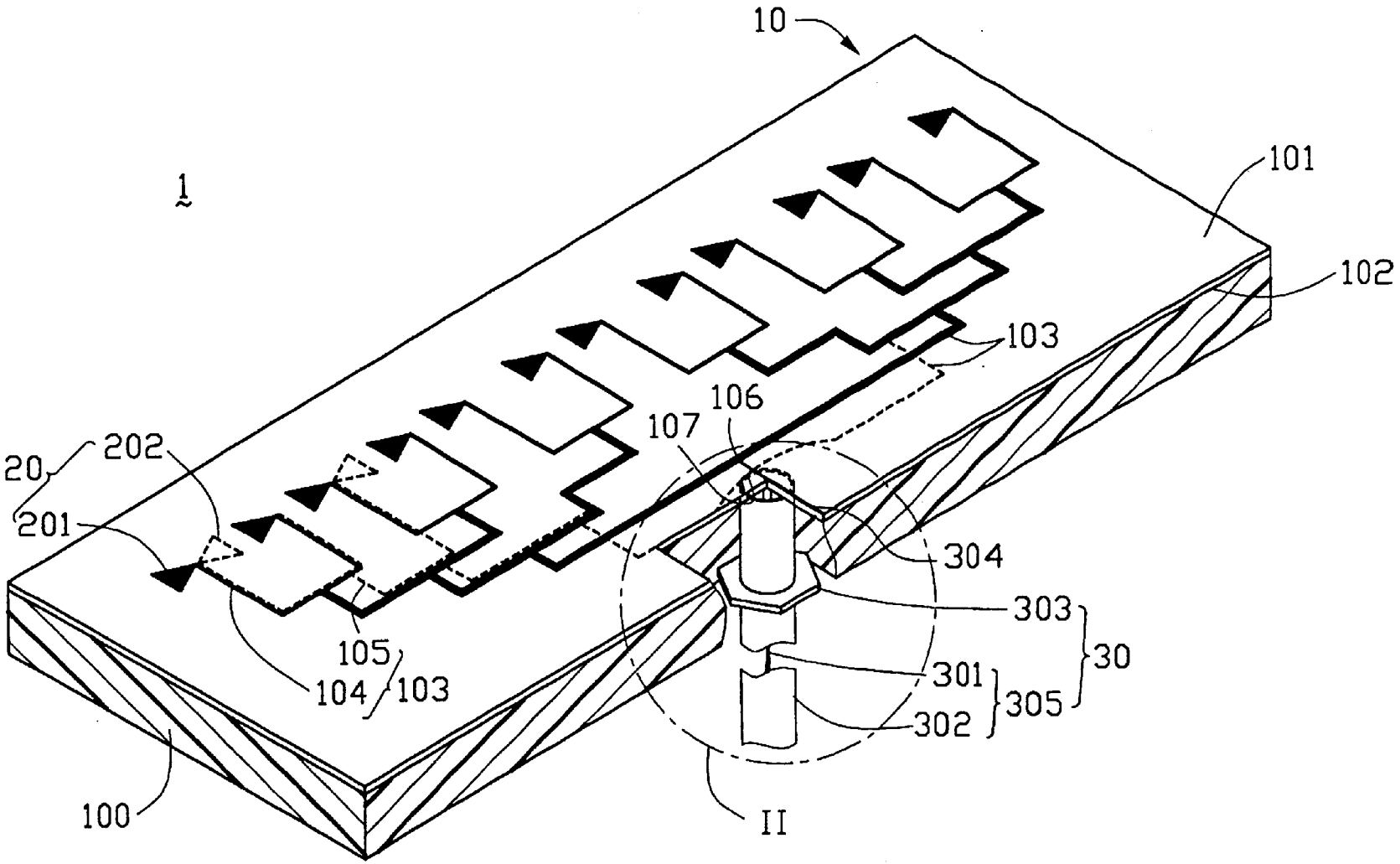
FIG. 1 is a perspective view of a planar printed circuit antenna in accordance with the present invention, with partial cutouts to illustrate details of a coaxial feeder element thereof.

Referring to FIG. 1, a planar printed circuit antenna 1 in accordance with the present invention comprises a printed circuit board (PCB) 10 mounted on an insulative substrate 100, a plurality of electronic dipole units 20 provided on the PCB 10, and a coaxial feeder element 30.

The PCB 10 comprises an upper layer 101, and a lower layer 102 adjacent the upper layer 101 and fixed on the insulative substrate 100. Each dipole unit 20 comprises a first half dipole 201 on the upper layer 101 and a second half dipole 202 on the lower layer 102. Balun circuit traces 103 comprise a first circuit trace 104 disposed upon the upper layer 101, and a second circuit trace 105 (shown in dashed lines) disposed upon the lower layer 102. The first and second circuit traces 104, 105 comprise substantially identical circuit patterns, and are disposed substantially opposite each other upon the upper and lower layers 101 and 102 respectively. The first and second circuit traces 104, 105 comprise a plurality of distal ends electrically connecting with the first and second half dipoles 201, 202 respectively of the electronic dipole units 20. The coaxial feeder element 30 includes an RF cable 305, and a neck 303 securely attached around the RF cable 305 for engaging the coaxial feeder element 30 with the substrate 100 by conventional means. The RF cable 305 includes a conducting core wire 301, and an outer conductor 302 enveloping the conducting core wire 301.

Figure 2:
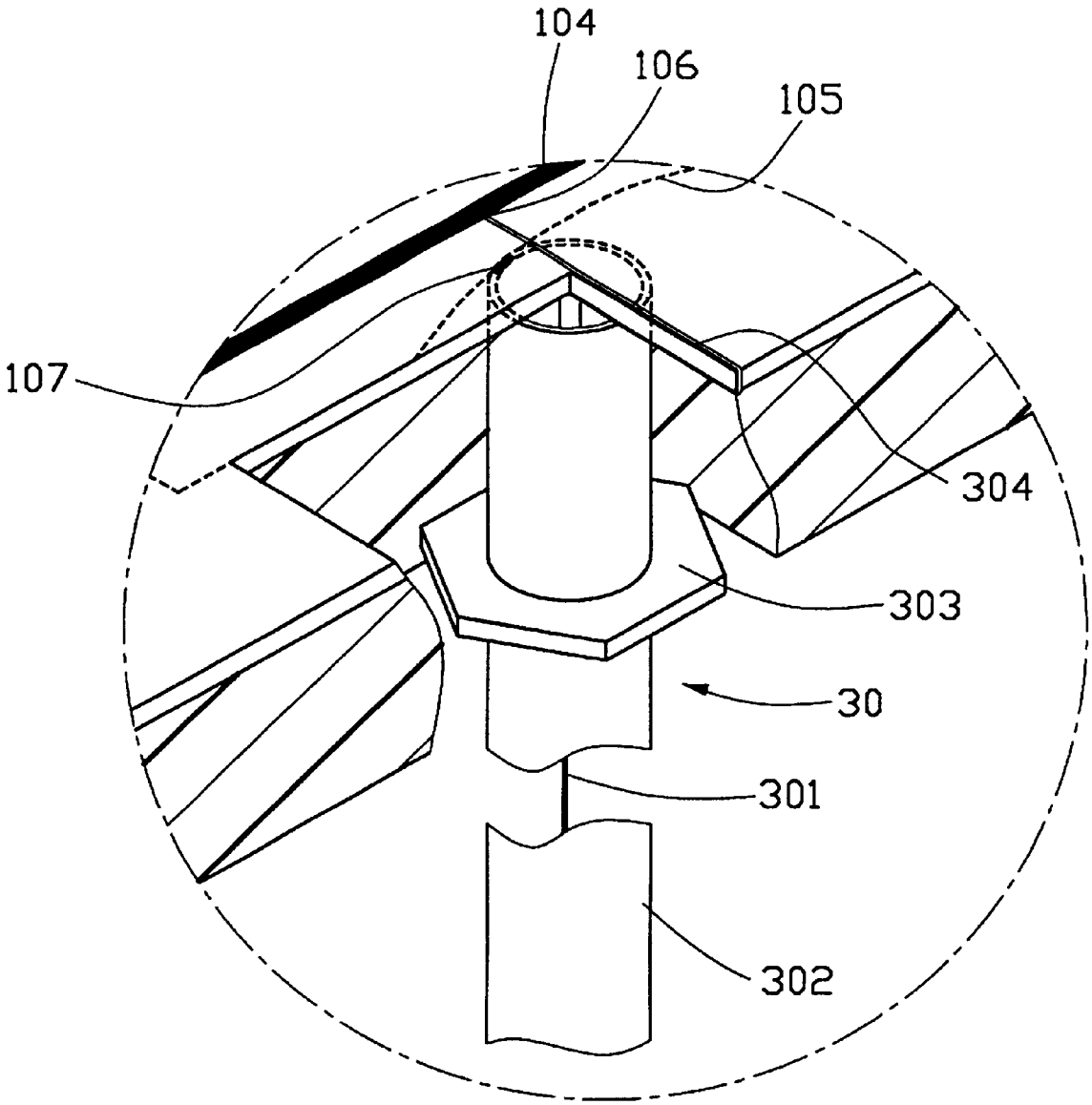
FIG. 2 is an enlarged view of that part of FIG. 1 indicated by the circle II.
Figure 3:
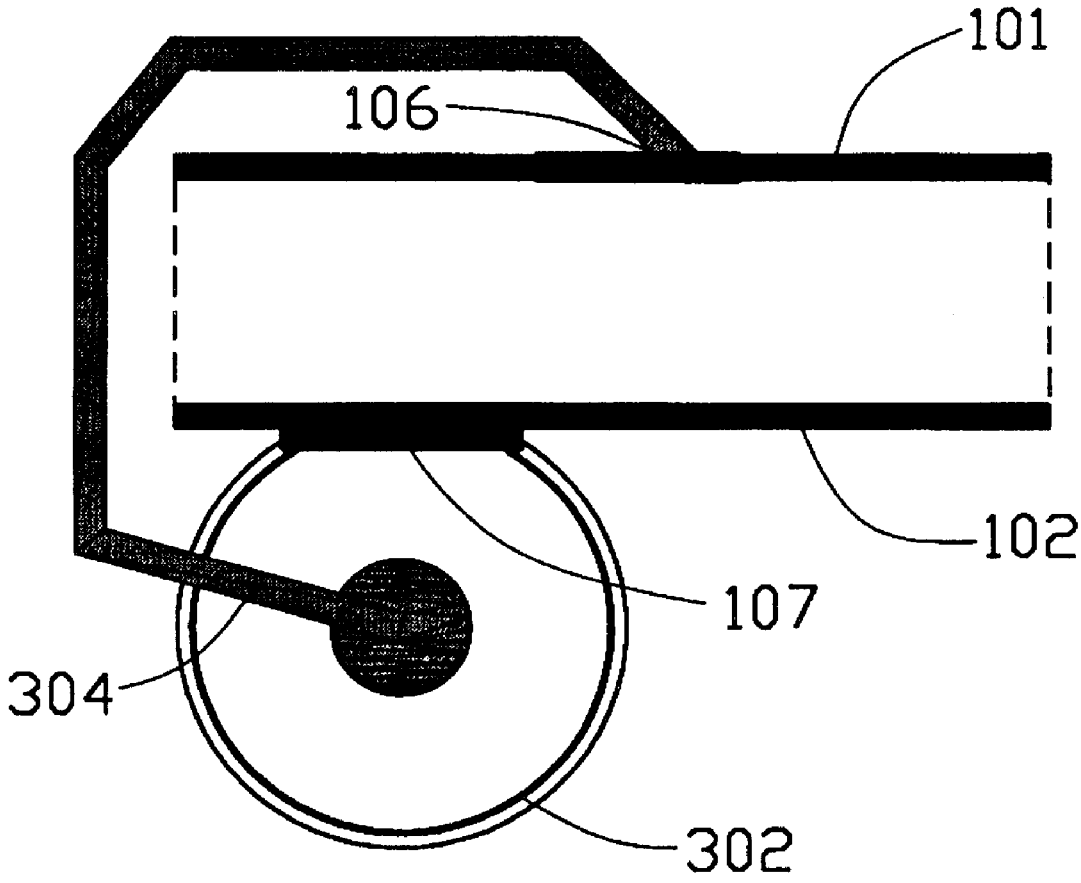
FIG. 3 is a schematic representation of a planar printed circuit antenna feeding through via a jumper wire from a coaxial feeder element, in accordance with the present invention.

Referring particularly to FIG. 2, the PCB 10 has space available (not labeled) for accommodating a jumper wire 304 of variable length. The jumper wire 304 has an insulative coating. Referring additionally to FIG. 3, the jumper wire 304 connects an end section (not labeled) of the conducting core wire 301 with the first circuit trace 104 of the PCB 10. One end of the jumper wire 304 is welded to the first circuit trace 104 on the upper layer 101 of the PCB 10 at a first feed-in point 106. The other end of the jumper wire 304 is welded to the end section (not labeled) of the conducting core wire 301. The outer conductor 302 is directly connected to the second circuit trace 105 on the lower layer 102 of the PCB 10, by means of welding at a second feed-in point 107.

Figure 4:
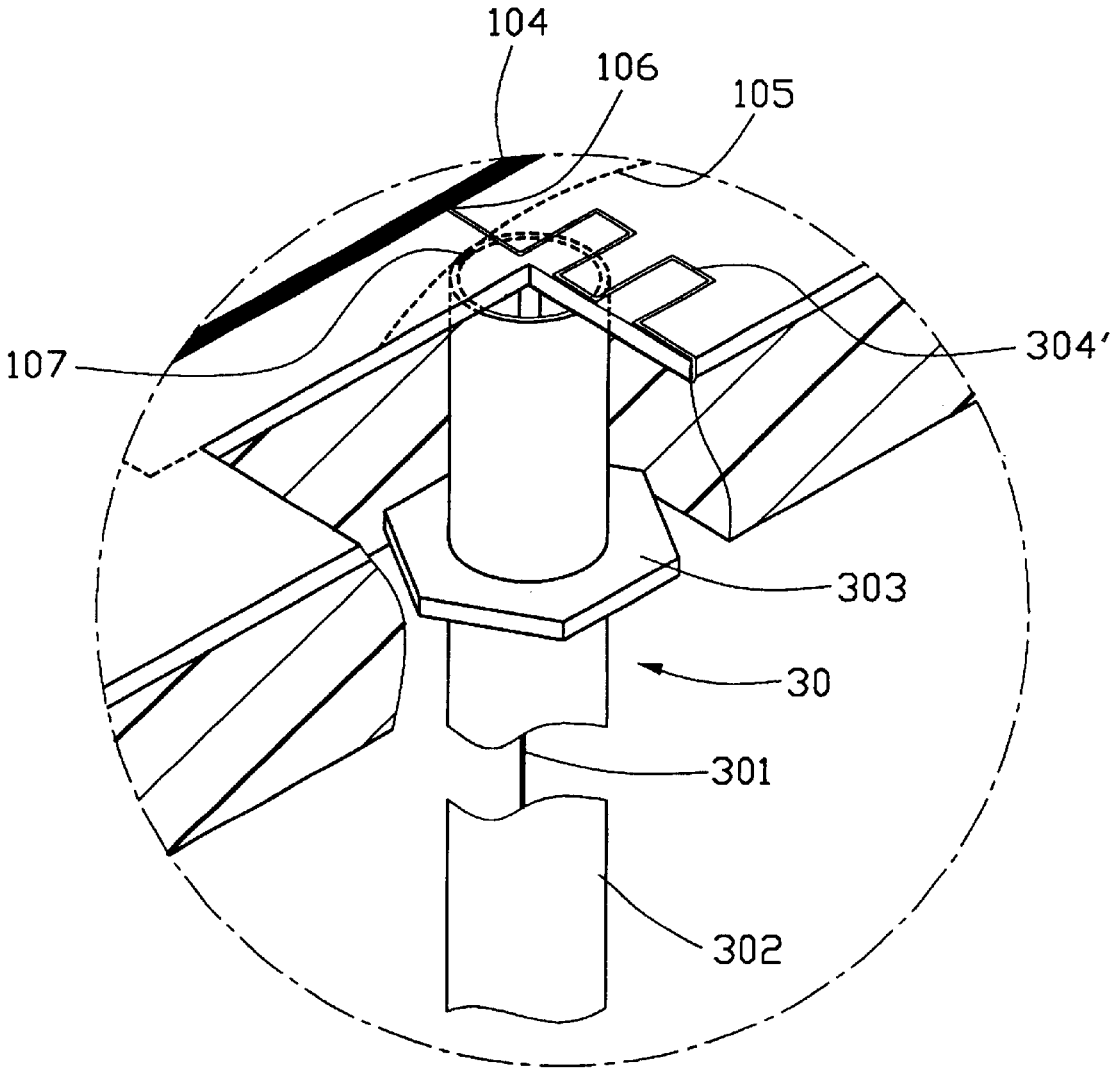
FIG. 4 is similar to FIG. 2, but having a substituted jumper wire longer than the jumper wire of FIG. 2.

In cooperation with the available space (not labeled) of the PCB 10, the jumper wire 304 is easily substituted by another jumper wire having a different length. Each end of the jumper wire 304 is unwelded, and the jumper wire 304 is removed from the antenna 1. Then each end of the substitute jumper wire is welded in place. For example, in FIG. 4, a jumper wire 304' longer than the jumper 304 has been substituted in place of the jumper wire 304.

Signals arriving at the coaxial feeder element 30 are transmitted through the jumper wire 304 to the electronic dipole units 20 of the antenna 1. According to antenna theory, a syntonous frequency band shifts when the length of an antenna changes. The length of the antenna 1 of the present invention varies according to the length of the jumper wire 304. Thus the syntonous frequency band of the antenna 1 shifts if the jumper wire 304 is substituted with another jumper wire having a different length. Therefore, the effective frequency band of the antenna 1 can be modified by substituting the jumper wire 304 with another jumper wire having a different length.

The jumper wire 304 of the planar printed circuit antenna 1 is readily coupled with the first circuit trace 104 of the antenna 1, and occupies a small space. Additional integrated circuits (for example, symmetrical transducers) are not needed, making the present invention ideal for portable electronic equipment.

Figure 5:
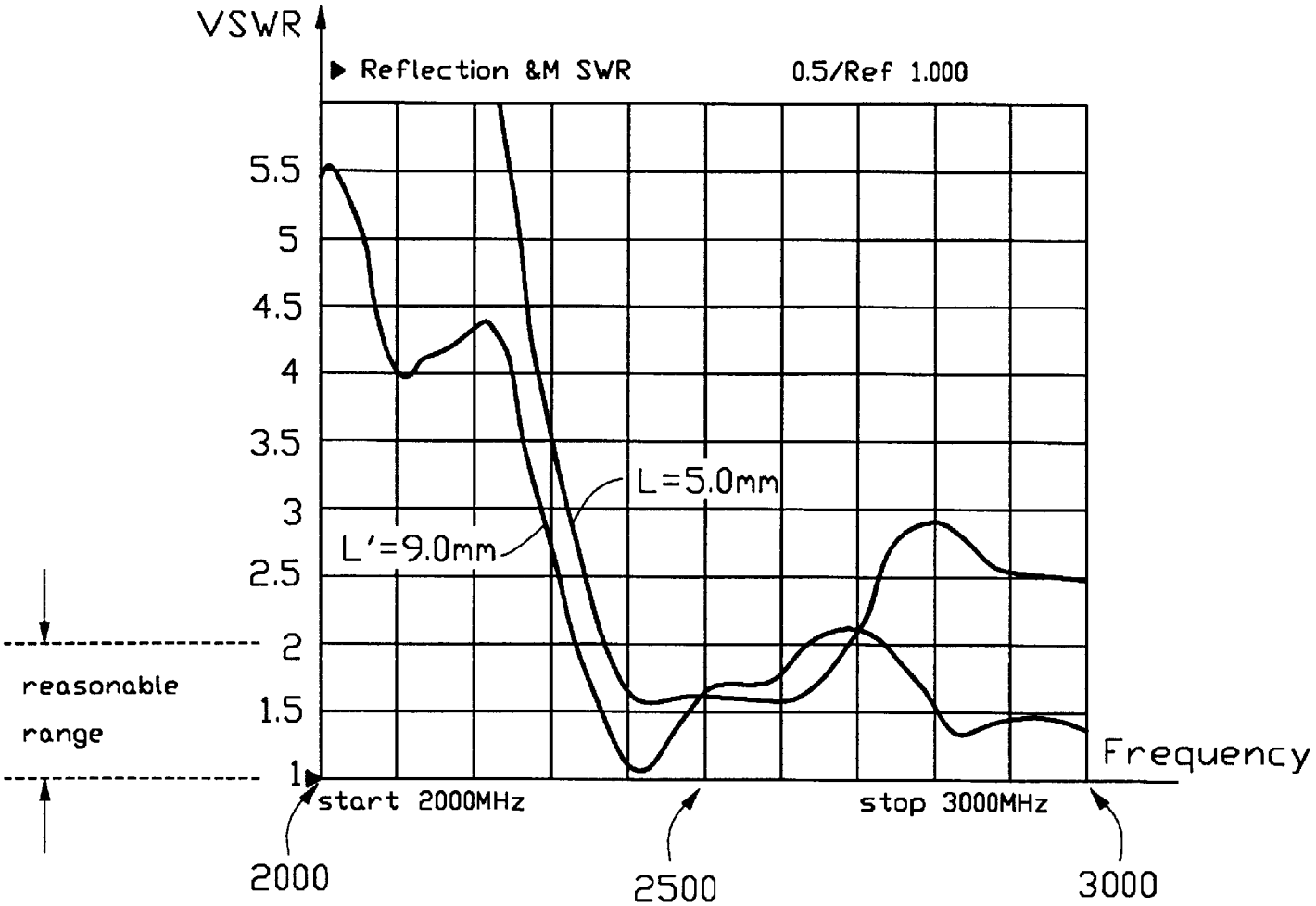
FIG. 5 is a graph of experimental data obtained for the present invention, showing frequency on the horizontal axis varying with Voltage Standing Wave Ratio (VSWR) on the vertical axis.
Figure 6:
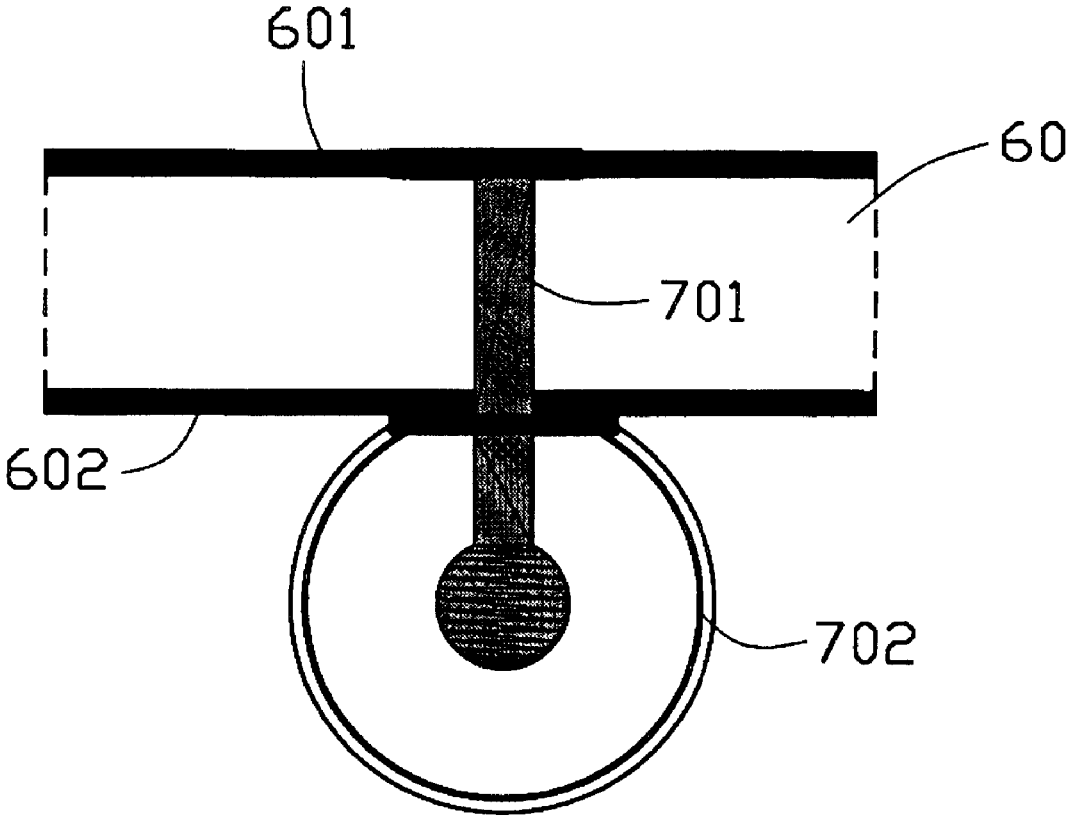
FIG. 6 (PRIOR ART)
FIG. 6 is a schematic representation of a conventional planar printed circuit antenna feeding through directly from a coaxial feeder element.
Figure 7:
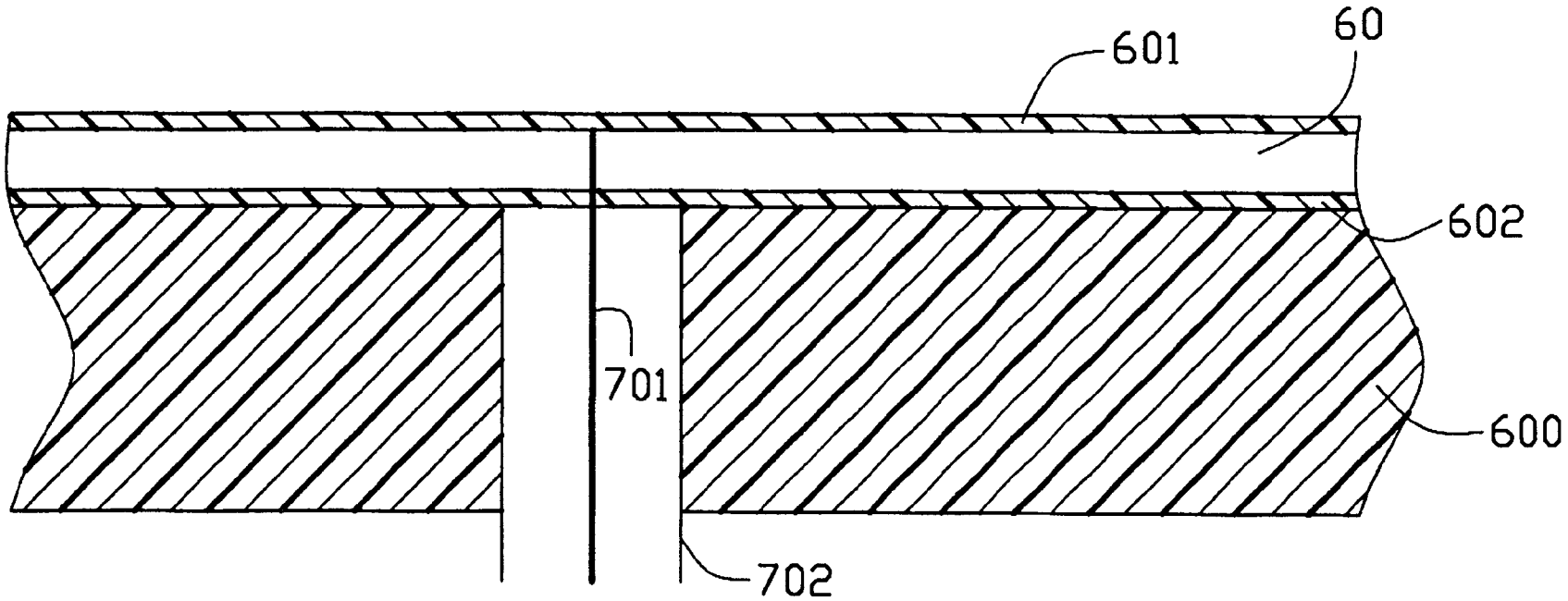
FIG. 7 (PRIOR ART)
FIG. 7 is a partial cross-sectional view of the same conventional planar printed circuit antenna represented in FIG. 6.

FIG. 5 is a graph of experimental data obtained for an embodiment of the present invention, showing frequency on the horizontal axis varying with Voltage Standing Wave Ratio (VSWR) on the vertical axis. The VSWR determines the rate of power feeding into the antenna under a certain frequency, and the characteristics of the antenna under such frequency. Generally the VSWR is reasonable when it is greater than 1.0. When the VSWR is less than 2.0, up to 10% of energy is reflected back, and the remaining energy is radiated out through the antenna. Thus a frequency band for which the VSWR is less than 2.0 is often desired by persons skilled in the art encompassing the present invention. Antenna designers accordingly seek to attain a VSWR greater than 1 and less than 2 under the desired frequency band. Products created by such designers include, for example, Bluetooth apparatus, wireless LANs, 2.4~2.5 GHz apparatus, and so on.

In FIG. 5, if the length of the jumper wire 304 is 5.0 mm, the frequency band is from 2376 MHz to 2684 MHz. If the length of the jumper wire 304' is 9.0 mm, the frequency band is from 2330 MHz to 2629 MHz. These two ranges of frequency band are within the effective Industry, Science, Medicine (ISM) frequency band. The frequency band of the antenna shifts noticeably according to variation of the length of the jumper wire 304/304'. Users can select the appropriate jumper wire length needed to obtain the desired corresponding frequency band range.

In summary, the experimental data shows that the effective frequency band of the antenna 1 shifts when the length of the jumper wire 304 is changed. Thus the experimental data fully supports antenna theory. The planar printed circuit antenna 1 not only conforms to antenna theory, but also conveniently allows a broader scope of operation.

The present invention has been described according to a preferred embodiment. It can also be applied as desired in wireless communication modules for notebook PCs, Bluetooth apparatus, Wireless LANs, 2.4~2.5 GHz apparatus, and so on.

It is to be understood, however, that even though numerous characteristics and advantages of the present invention have been set forth in the foregoing description, together with details of the structure and function of the invention, the disclosure is illustrative only, and changes may be made in detail, especially in matters of configuration, size, and arrangement of parts within the principles of the invention to the full extent indicated by the broad general meaning of the terms in which the appended claims are expressed.

What is claimed is:

1. A planar printed circuit antenna used for an electronic device, comprising:

a printed circuit board comprising an upper layer, and a lower layer;

a plurality of electronic dipole units each comprising a first half dipole arranged on the upper layer and a second half dipole arranged on the lower layer;

a feeder element including an RF cable, the RF cable having a conducting core wire and an outer conductor respectively electrically connecting with said upper and lower layers of the printed circuit board; and a jumper wire connecting the conducting core wire to the upper layer of the printed circuit board, the jumper wire in cooperation with the printed circuit board being adapted to be easily substituted by another jumper wire having a different length, thereby changing an effective frequency band of the antenna.

2. The planar printed circuit antenna in accordance with claim 1, wherein the printed circuit board has space available for accommodating a jumper wire of varying length.

3. The planar printed circuit antenna in accordance with claim 1, wherein the jumper wire has an insulative coating.

4. The planar printed circuit antenna in accordance with claim 1, wherein the printed circuit board is mounted on an insulative substrate, and wherein the feeder element comprises at least a neck engaging with the insulative substrate.

5. The planar printed circuit antenna in accordance with claim 1, wherein the printed circuit board further comprises balun circuit traces having a first circuit trace on the upper layer and a second circuit trace on the lower layer, the first and the second circuit traces electrically coupling with said RF cable of said feeder element.

6. The planar printed circuit antenna in accordance with claim 5, wherein said first and second circuit traces have distal ends electrically connecting with the first and the second half dipoles respectively of the electronic dipole unit.

7. A planar printed circuit antenna used for an electronic device, comprising:

a printed circuit board comprising an upper layer, and a lower layer;

a plurality of electronic dipole units each comprising a first half dipole arranged on the upper layer and a second half dipole arranged on the lower layer; and a feeder element including an RF cable, the RF cable having a conducting core wire and an outer conductor enveloping the conducting core wire; wherein said printed circuit board leaves a space to permissibly have the outer conductor to be directly welded to the lower layer while the conducting core wire to be indirectly connected to the upper layer through a jumper wire; wherein said conductive core wire terminates at the lower layer and does not extend through said printed circuit board, and said jumper wire with an insulative coating, extends along the lower layer, successively upwardly toward the upper layer, and finally along the upper layer.

8. The antenna in accordance with claim 7, wherein said upper layer reserves sufficient space thereon to allow said jumper wire to define a zigzag type path for increasing a length thereof.

* * * * *